US008535026B2

(12) United States Patent
Chen et al.

(10) Patent No.: US 8,535,026 B2
(45) Date of Patent: Sep. 17, 2013

(54) MECHANICAL SYSTEM FOR MOVEMENT ALONG A HOUSING AXIS

(75) Inventors: Kuo-Chiang Chen, Sugar Land, TX (US); Aaron Jacobson, Houston, TX (US); Nathaniel Wicks, Somerville, MA (US); Murat Ocalan, Boston, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 366 days.

(21) Appl. No.: 12/827,536

(22) Filed: Jun. 30, 2010

(65) Prior Publication Data

US 2012/0003111 A1 Jan. 5, 2012

(51) Int. Cl.
*F04B 41/06* (2006.01)

(52) U.S. Cl.
USPC ..... 417/521; 166/66; 166/254.2; 73/152.46

(58) Field of Classification Search
USPC ..... 417/521; 166/66, 254.2; 73/152.46
See application file for complete search history.

(56) References Cited

U.S. PATENT DOCUMENTS

| | | | | |
|---|---|---|---|---|
| 2,349,712 | A * | 5/1944 | Fearon | 250/269.6 |
| 4,475,386 | A | 10/1984 | Fitch et al. | |
| 4,520,665 | A * | 6/1985 | Cordier et al. | 73/152.19 |
| 4,799,546 | A * | 1/1989 | Hensley et al. | 166/254.2 |
| 4,925,371 | A * | 5/1990 | Griesmar | 417/18 |
| 5,448,912 | A | 9/1995 | Black | |
| 5,970,787 | A | 10/1999 | Wignall | |
| 6,671,057 | B2 | 12/2003 | Orban | |
| 6,997,258 | B2 * | 2/2006 | Homan et al. | 166/254.2 |
| 7,069,780 | B2 | 7/2006 | Ander | |
| 7,640,979 | B2 | 1/2010 | Watson et al. | |
| 2009/0223291 | A1 | 9/2009 | Donadille et al. | |

OTHER PUBLICATIONS

Brady et al., "SPE 26095: Gravity Methods: Useful Techniques for Reservoir Surveillance," SPE International, 1993: pp. 645-658.

* cited by examiner

*Primary Examiner* — Charles Freay
*Assistant Examiner* — Patrick Hamo
(74) *Attorney, Agent, or Firm* — Bridget Laffey; Rachel E. Greene; Jakub Michna

(57) ABSTRACT

A mechanism for moving elements in a fluid filled housing using a pump with the element to be moved attached rigidly to the pump or to a port assembly connected to the pump. The pump assembly or port assembly moves as a result of differential pressure created between a first and a second chamber separated from each other by the pump assembly or port assembly. Movement of the fluid in one direction increases or decreases pressure, the pressure change resulting in a net force in one direction or the other.

25 Claims, 5 Drawing Sheets

MECHANICAL SYSTEM FOR MOVEMENT ALONG A HOUSING AXIS

FIELD OF THE DISCLOSURE

The subject disclosure generally relates to the field of sensors and more particularly to mechanisms used to move sensors along the length of a housing of an oilfield tool.

BACKGROUND OF THE DISCLOSURE

Oil exploration involves evaluating reservoirs to determine the movement or absence of oil, gas, or water as the reservoir fluids are produced. Understanding movement of gas in reservoirs is important to the prevention of premature breakthroughs and optimization of reservoir performance. It is known to use gravity borehole tools to measure characteristics of geologic formation, particularly in the exploitation of hydrocarbon reservoirs found in geologic formations or in the subsurface storage of carbon dioxide or water.

The process of measuring physical properties of earth formations beneath the surface of the earth is commonly referred to as "well logging". It comprises the step of lowering sensors or testing equipment mounted on robust tool bodies into a wellbore drilled through the earth. When the tool is suspended from an armored cable the process is more specifically referred to as "wireline" well logging. Alternative conveyance techniques as known in the art include lowering the instruments mounted on drill pipe, casing or production tubing or on coiled tubing. The drill pipe conveyance technique, in particular, is known as "logging while drilling" when measurements are performed during the actual drilling of a wellbore.

Borehole gravity measurements are a direct measure of the bulk density of the formation surrounding a wellbore. Typically gravity data are taken at different vertical depths or stations along the wellbore. The basic principle of borehole gravity measurements is that the change in gravity relates directly to the bulk density contrast of the formation, the distance from the stations and the density contrast body. The bulk density in turn is directly related to grain densities and the pore fluid (gas, oil or water) densities and porosity of the formation. Several gravity measurement tools are commercially available. U.S. Pat. No. 5,970,787 to Wignall describes a tool for conducting gravimetric survey downhole in an earth formation.

One limitation to using gravity sensors is that the accuracy of the gravity measurement may be insufficient for making gravity density measurements in boreholes. Gravity sensors are extremely sensitive to vibrations and these vibrations may throw the gravity sensors out of calibration. Further, even if the sensor remains calibrated after being subjected to vibrations the sensor will take time to settle which is undesirable as it reduces the logging speed and increases the chance of having the tool stuck in the wellbore. Minimizing both noise and vibrations in the gravity measurements may increase this accuracy.

SUMMARY OF THE DISCLOSURE

In view of the above there is a need for an improved mechanism which permits movement of sensors along the length of a tool housing with a minimum of noise and vibrations. The subject technology accomplishes these and other objectives. The subject disclosure provides a drive system without traditional mechanical contacts e.g. metal to metal via gears, therefore, minimizing noise and vibrations in the gravity measurements.

In accordance with an embodiment of the subject disclosure, an apparatus comprising an elongated, hollow vessel is disclosed. The apparatus further comprises a fluid filled housing disposed inside the vessel with the housing defining a hydraulically isolated chamber. A pump member is disposed inside the hydraulically isolated chamber and an element is attached to the pump. The pump member provides a differential pressure which moves the pump member and element inside the length of the housing.

In accordance with a further embodiment of the subject disclosure, an apparatus comprising an elongated, hollow vessel with a fluid filled housing disposed inside the vessel is disclosed. The apparatus further comprises a housing defining a hydraulically isolated chamber and a pump member disposed inside the hydraulically isolated chamber and attached to the housing. Flexible tubing connecting the pump member to a port assembly having an element attached to the port assembly is also disclosed. Finally, the pump member provides a differential pressure thus moving the port assembly and element inside the length of the housing.

In accordance with a further embodiment of the subject disclosure, a method for moving an element inside a housing is disclosed. This method comprises disposing a fluid filled housing inside an elongated, hollow vessel and defining a hydraulically isolated chamber within the fluid filled housing. The method further comprises disposing a pump member inside the hydraulically isolated chamber and attaching an element to the pump. A differential pressure is provided by the pump member thus moving the pump member and element inside the length of the housing.

Further features and advantages of the subject disclosure will become more readily apparent from the following detailed description when taken in conjunction with the accompanying drawings.

DETAILED DESCRIPTION

Figure 2:
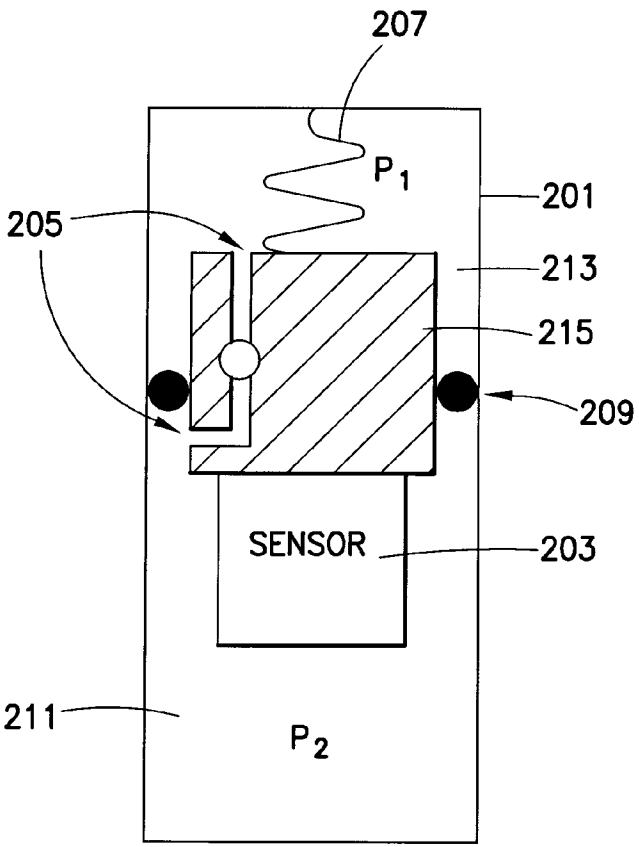
FIG. 2 illustrates one embodiment of the subject disclosure.

The present technology is directed to a mechanism for moving objects along the axis of a confining cylinder. More particularly, the present technology is directed to a mechanical system for moving sensors in a longitudinal direction in a housing of an oilfield tool. The direction of motion of the mechanism is in the longitudinal direction of the oilfield tool.

Embodiments of the present technology comprise a pump. In one non-limiting example, the pump is a bidirectional pump with a first outlet for pumping fluid to operate the system in a first direction and a second outlet for pumping fluid to operate the system in a second direction. These bidirectional pumps are commercially available. In non-limiting examples, these bidirectional pumps may be positive displacement pumps for example, a progressing cavity pump. As will be apparent to one skilled in the art, any commercial available bidirectional pump may be used. Typically, electrical, hydraulic or pneumatic means are used in energizing these pumps. The pump moves an object along the axis of a housing. In one non-limiting example the housing is a confining cylinder and may be the housing of an oilfield tool, e.g., wireline or drilling tool. One skilled in the art will recognize that the subject disclosure has numerous non-oilfield applications for example, pneumatic tube systems used at drive-in banks for transporting cash and documents between the customer and the teller. The housing may be a drill collar or any other type of tubular structure that may be used to package an oilfield tool for example, a wireline tool, LWD tool or a tool moving inside a cased well for example, an intelligent "plug" comprising additional measurement tools capable of moving down the well by itself, instead of being pumped down the wellbore, e.g., cement plug. The element to be moved is attached to one side of the pump. The element is physically attached to the pump utilizing methods which are known to those skilled in the art which include in non-limiting examples welded, screwed or pinned. In one non-limiting example the element is a sensor, for example, a gravity sensor. The housing is filled with a fluid which may be pumped by the pump in either direction. The fluid may comprise any gas or liquid. In non-limiting examples the fluid may be one of oil or water or both oil and water. The pump moves fluid from the bottom to the top or vice versa within the housing. When the pump moves fluid from the bottom to the top, the pressure on the bottom decreases and the pressure on the top increases, resulting in a net downwards force on the pump-element assembly. The assembly will move downwards until the pressure equilibrates on the top and bottom. The pump direction can be reversed therefore moving the pump-object assembly in the opposite direction.

In one non-limiting example the apparatus comprises a sensor attached to a pump. The apparatus is located in a tool housing. The first and second outlets of the pump are located above and below a seal and in one non-limiting example the seal is a dynamic seal which seals between the pump-sensor assembly and the housing. In non-limiting examples these dynamic seals comprise elastomeric materials or polymers for example Teflon. In other examples these dynamic seals may comprise a plurality of different materials. The housing is filled with a fluid and the fluid can be pumped through the pump in either direction. The pump is attached electrically to the housing via a flexible cable. The cable in one non-limiting example may be a helical electrical line. The cable is flexible to accommodate the length change when the apparatus moves from a first position to a second position. The cable also provides electrical continuity of the pump/sensor assembly with the housing which ensures power is provided into the pump/sensor assembly and a signal can be transmitted between the pump/sensor assembly and the housing. The flexible cable provides a connection to a control unit for the apparatus which controls the pump/sensor assembly within the housing. Referring now to the drawings, in which like numerals represent like elements through the several figures, aspects of the subject disclosure will be described.

Figure 1:
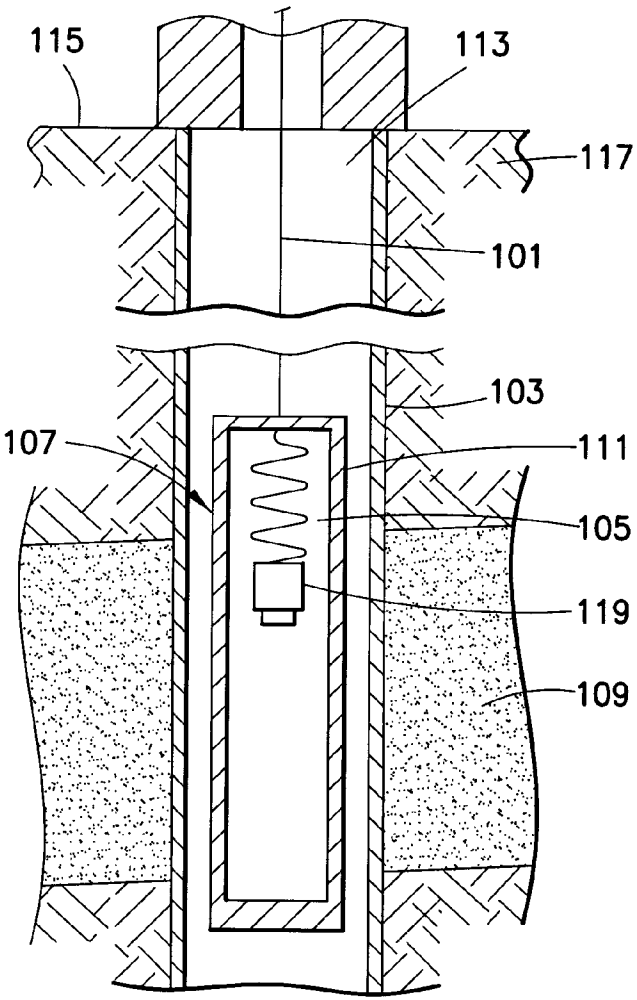
FIG. 1 illustrates a wellsite system in which the subject disclosure can be employed.

FIG. 1 illustrates a diagrammatic illustration of the apparatus of the present disclosure wherein a wellbore tool 107 is diagrammatically illustrated in a borehole 113 below the surface of the earth 115 which is cased 103. In FIG. 1, the section 117 includes a geological formation 109, which is of interest as to its overall thickness and potential as to oil and gas production or mineral bearing content. The wellbore tool 107 is attached to a cable e.g. a wireline cable which is used to raise and lower the wellbore tool 107 within the borehole 113. The diagram depicts a diagrammatic illustration of the apparatus of the present disclosure in use within a cased borehole but the apparatus could also be employed in an uncased borehole. The wellbore tool 107 comprises a housing 111 connected to a pump/sensor assembly 119 via a flexible cable 105. Although, FIG. 1 shows the wellbore tool in a vertical borehole 113, it should be clear that the present disclosure is not limited to a vertical borehole 113 but can be used in a deviated or horizontal borehole.

FIG. 2 illustrates one embodiment of the present disclosure in more detail. The housing 201 can be deployed in the wellbore tool 107. The housing comprises a fluid 211 which can be pumped through the pump in either direction. The housing 201 is hydraulically isolated from the borehole. The housing 201 further comprises a pump/sensor assembly 213. The pump 215 which in one non-limiting example is a bidirectional pump has inlets/outlets 205 with a dynamic seal 209. A sensor 203 which will move along the length of the housing is attached to the pump 215. The pump 215 provides the thrust to move the pump/sensor assembly 213 inside the length of the housing 201. The pump/sensor assembly 213 can be compared to an elevator assembly moving along the length of the housing 201. The distance the pump/sensor assembly 213 moves will be limited by the length of the housing. Displacement of the pump/sensor assembly 213 is achieved by the fluid 211 moving from one side, upper or lower of the pump/sensor assembly 213 to the other upper or lower side of the pump/sensor assembly 213. Referring to FIG. 2 when fluid is moved from the upper to lower portion of the housing the pump/sensor assembly 213 is moving up. Conversely, when fluid is pumped from the lower to the upper portion of the housing the pump/sensor assembly 213 is moving down. Movement of the pump/sensor assembly 213 can be controlled by adjusting the volume of the fluid which is being pumped. Further, the direction of movement can also be controlled by adjusting the volume of the fluid which is being pumped. The pump/sensor assembly 213 is maintained at a given position along the axis of the housing 201 by the pump 215 which sets the pressure of the fluid P1 and P2 to balance the buoyant weight of the pump/sensor assembly 213. In certain instances, it may also be desirable to match the density of the fluid to the density of the pump/sensor assembly 213 in order to achieve neutral buoyancy thus maintaining the apparatus in a stationary position when the pump is shut down. The pump 215 is attached to the housing with a flexible cable 207.

Figure 3A:
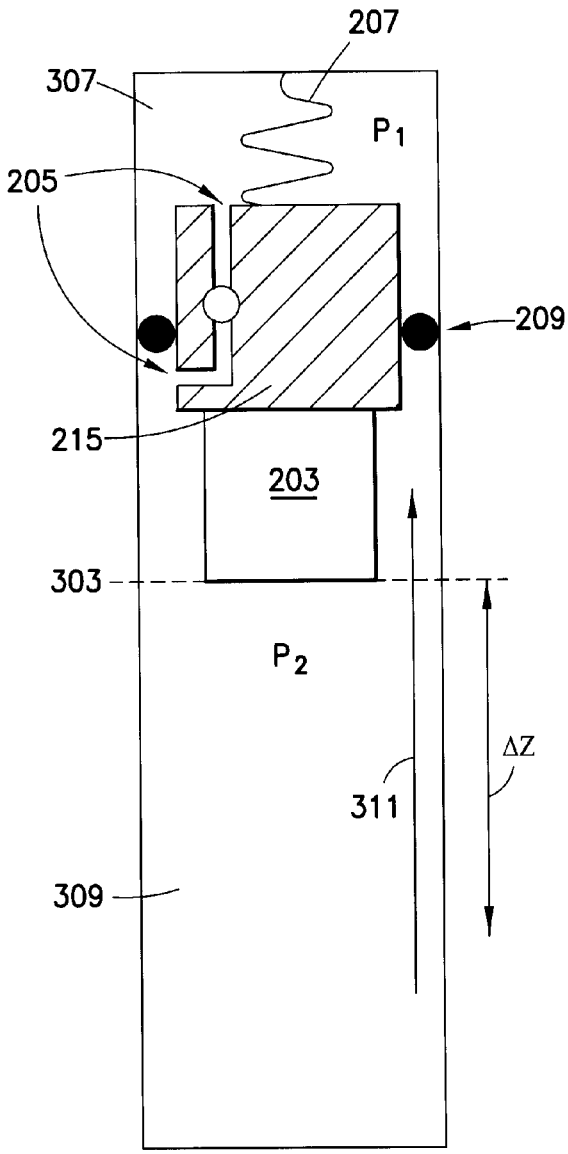
FIG. 3 illustrates the embodiment of FIG. 1 shown in two different positions for use in taking sensor readings of a geological formation.
Figure 3B:
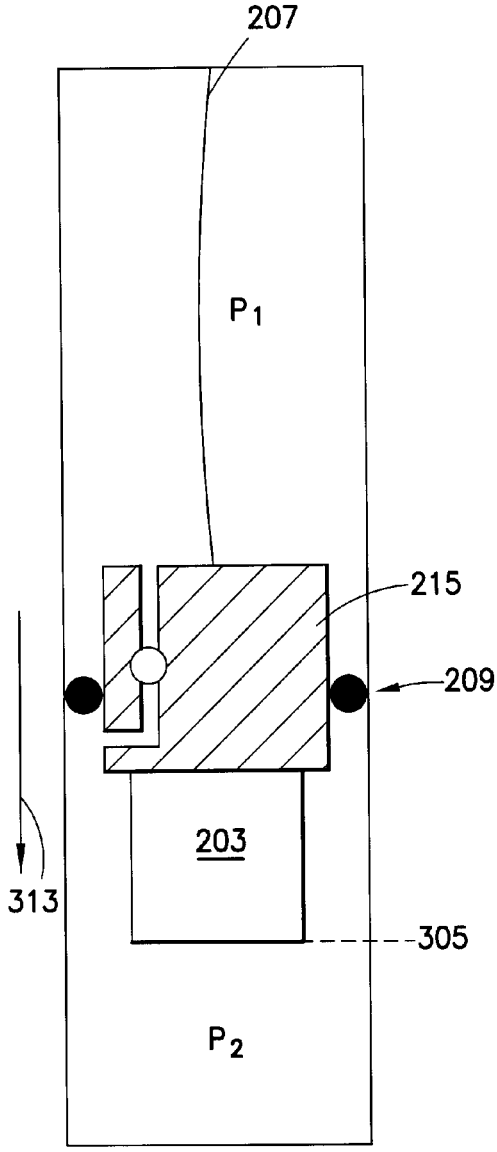

FIGS. 3A and 3B illustrate movement of the pump/sensor assembly 213 within the housing 201. The pump 215 enables this movement within the housing 201 by pumping fluid from one side of the pump/sensor assembly 213 to the other. In FIG. 3A, the pump 215 moves fluid from a first chamber 309 to a second chamber 307 and is depicted in FIG. 3A as fluid moving from the bottom to the top 311. As the fluid moves in the direction of 311, the pressure P1 in chamber 307 increases and the pressure P2 in chamber 309 decreases. This results in a net downward force on the pump/sensor assembly 213. This pump/sensor assembly 213 moves in the direction 313 which is depicted as downwards in FIG. 3B. The pump/sensor assembly 213 moves from a first position 303 to a second position 305 by a distance of $\Delta z$. The pump/sensor assembly 213 moves in the direction 313 until the pressure difference matches the buoyant weight of the pump/sensor assembly 213. Movement of the pump/sensor assembly 213 in the direction 313 causes the flexible cable 207 to stretch. Similarly, movement in the opposite direction would adjust the flexible cable 207 and return the cable to its original position.

Environmental changes and fluid leakage from the housing 201 may cause the first chamber 309 and second chamber 307 to have varying pressure while the pump/sensor assembly 213 is stationary. This in turn may result in a shift in the sensor position 203. The pump 215 may be utilized to correct the shift but in certain instances it may be advantageous to maintain an idle operation which will reduce mechanical or electromagnetic noise on the sensor 203. The pump/sensor assembly 213 may further comprise one or a plurality of devices which will rigidly lock the pump/sensor assembly 213 to the housing 201. The sensor position will therefore not shift as a result of vibration or mechanical shock therefore providing increased accuracy. Some non-limiting examples of these devices are hydraulic energy storage devices, valves or a physical locking mechanism.

Figures 4A, 4B, 4C, 4D:
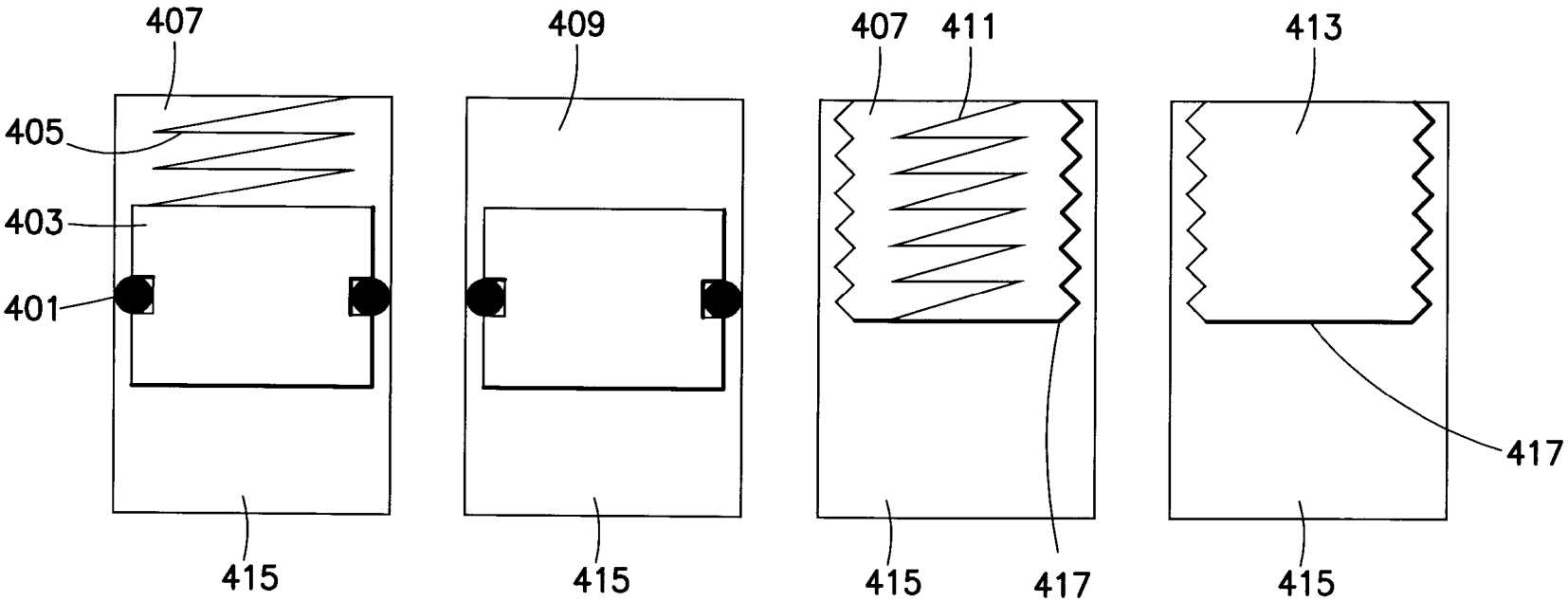
FIG. 4A-D illustrates examples of hydraulic energy storage devices.

FIGS. 4A-4D depicts examples of hydraulic energy storage devices. These hydraulic energy storage devices can be used to maintain a pump idle operation when the pump/sensor apparatus has traveled the length of the housing 201 and reached the end of the housing. These hydraulic energy storage devices will prohibit a shift in the sensor position 203 which may arise due to environmental changes or fluid leakage. These hydraulic energy storage devices can be hydraulically connected to the first chamber 309 or the second chamber 307. In alternative embodiments one or a plurality of energy storage devices can be connected to the first chamber 309 or the second chamber 307. A "hydraulic accumulator" refers to a hydraulic device that is able to store potential energy. FIG. 4A depicts a spring biased piston hydraulic accumulator. The dynamic seal 401 and movable piston 403 in the spring biased piston accumulator separates two chambers, one adapted for containing a working fluid 415 and the other adapted for containing wellbore or atmospheric fluid 407. In this instance the compressible medium is a spring 405. Alternatively, the compressible medium can be a compressible fluid as in FIG. 4B. As working fluid is pumped into the first chamber 309 or the second chamber 307 the movable piston 403 moves against the compressible medium, e.g., spring and stores potential energy. As the compressible medium compresses, the working fluid 415 pressure exceed the wellbore pressure 407. This force provides a locking mechanism for the pump/sensor apparatus 213. The locking mechanism functions when the working fluid chamber has a higher pressure than the wellbore or atmospheric fluid chamber. At some later point in time, the pressurized fluid in the chamber can be released to allow the compressible medium, e.g., spring 405 to move the piston 403 in the other direction.

FIG. 4B depicts a compressible fluid charged piston. Similarly, when fluid is pumped into the reservoir the piston 403 moves against the compressible fluid 409. As the compressible fluid 409 compresses the working fluid 415 pressure exceed the wellbore pressure 407. This compressible fluid force similar to the spring force provides a locking mechanism. An example of a compressible fluid which may be used is nitrogen gas.

FIGS. 4C and 4D depict a metal bellow accumulator. The metal bellow accumulator comprises a pressure vessel with a metal bellows assembly separating the working fluid from either wellbore or atmospheric fluid in FIG. 4C and compressible fluid e.g. nitrogen in FIG. 4D.

Figure 5:
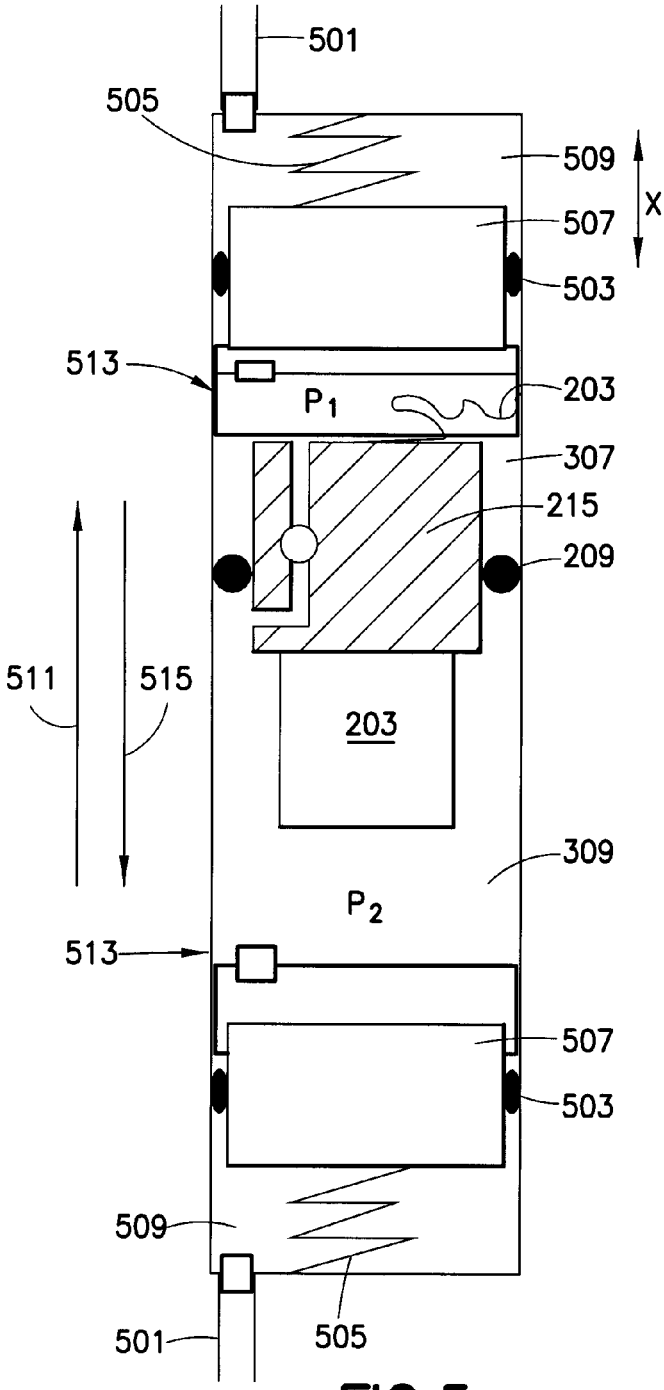
FIG. 5 illustrates a further embodiment of the subject disclosure.

FIG. 5 depicts one embodiment of the subject disclosure utilizing a hydraulic energy storage device. A hydraulic energy storage device is located on either side of the pump/sensor apparatus 213. The movable piston 507 is provided in a chamber 509 defined inside the housing 201. The piston is moveable in a longitudinal direction (indicated as of x) of the hydraulic energy storage device.

The working fluid 415 is compensated to wellbore or atmospheric fluid 407. As the fluid moves in the direction of 511, the pressure P1 in chamber 307 increases and the pressure P2 in chamber 309 decreases. This results in a net downward force on the pump/sensor assembly 213. This pump/sensor assembly 213 moves in the direction 515 which is depicted as downwards in FIG. 5. The working fluid is in hydraulic communication with both of the hydraulic energy storage devices and both hydraulic energy storage devices are in hydraulic communication with the wellbore 501. As discussed above when the working fluid is pumped into the first chamber 309 the movable piston 507 moves against the compressible medium, in this instance a spring and stores potential energy. As the compressible medium compresses the working fluid pressure 415 exceeds the wellbore pressure 407. This force provides a locking mechanism for the pump/sensor apparatus 213. When the pump/sensor assembly 213 reaches the end of the housing indicated as 513 the hydraulic energy storage device will maintain the pump/sensor assembly 213 in this position by locking the pump/sensor assembly 213 into this position.

Frictional losses may occur between the dynamic seals and the housing or in fluid viscous losses. Reducing frictional loss requires an increase in the pressure differential. Frictional losses may be used advantageously to dampen vibrations of the pump/sensor assembly as the pump/sensor assembly may continue movement even after the pressure has equilibrated and possibly "overshot" the targeted position.

Figure 6:
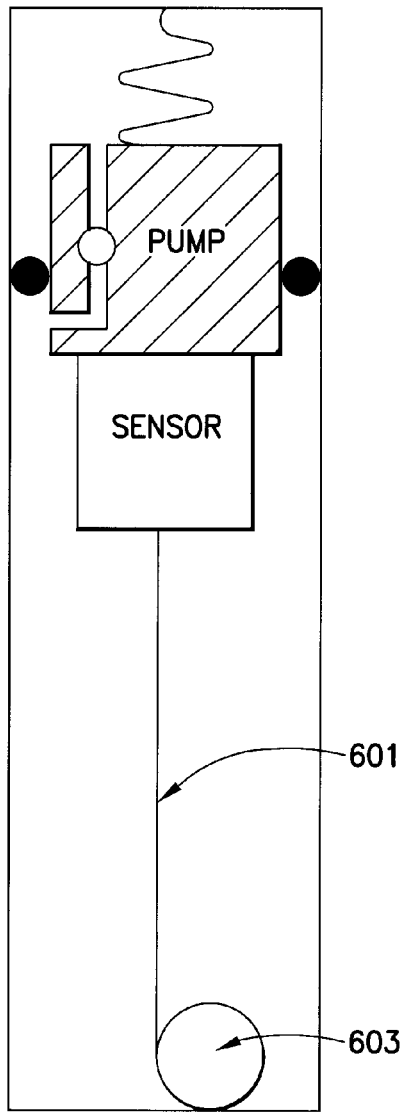
FIG. 6 illustrates an embodiment of the subject disclosure comprising a cable position transducer.

In order to obtain a position of the sensor inside the housing relative to the top or bottom of the housing a number of devices can be used. One such device is an optical encoder wheel which is held in contact with the housing. The encoder wheel provides a means for monitoring the position of the sensor inside the housing. The encoder wheel turns when the pump/sensor assembly 213 moves and this turning of the wheel is interpreted as a change in position of the pump/sensor assembly 213. A further method for monitoring the position of the sensor inside the housing comprises determining the amount of fluid displaced by the pump which in turn would determine how much the pump/sensor assembly had moved. Other methods that may be utilized to monitor the position of the sensor inside the housing include optical or acoustic methods e.g. ultrasonic which may be mounted on the housing or the pump/sensor assembly. FIG. 6 depicts a further mechanism which may be utilized to monitor the position of the sensor inside the housing. The mechanism comprises a cable position transducer 603 connected via a cable 601 to the pump/sensor assembly 213. The cable position transducer 603 may be located in the first chamber 309 or the second chamber 307. A variety of other devices may also be used to monitor the position of the sensor inside the housing which includes a linearly variable differential transducer (LVDT), linear potentiometer, or any type of linear measurement technique may be used to measure and control the position of the sensor. In order to control the position of the pump/sensor assembly 213, the measurements obtained by any of the devices mentioned above may be provided via real-time feedback to the housing. This will allow for real-time control of the movement of the pump/sensor assembly 213.

Figure 7:
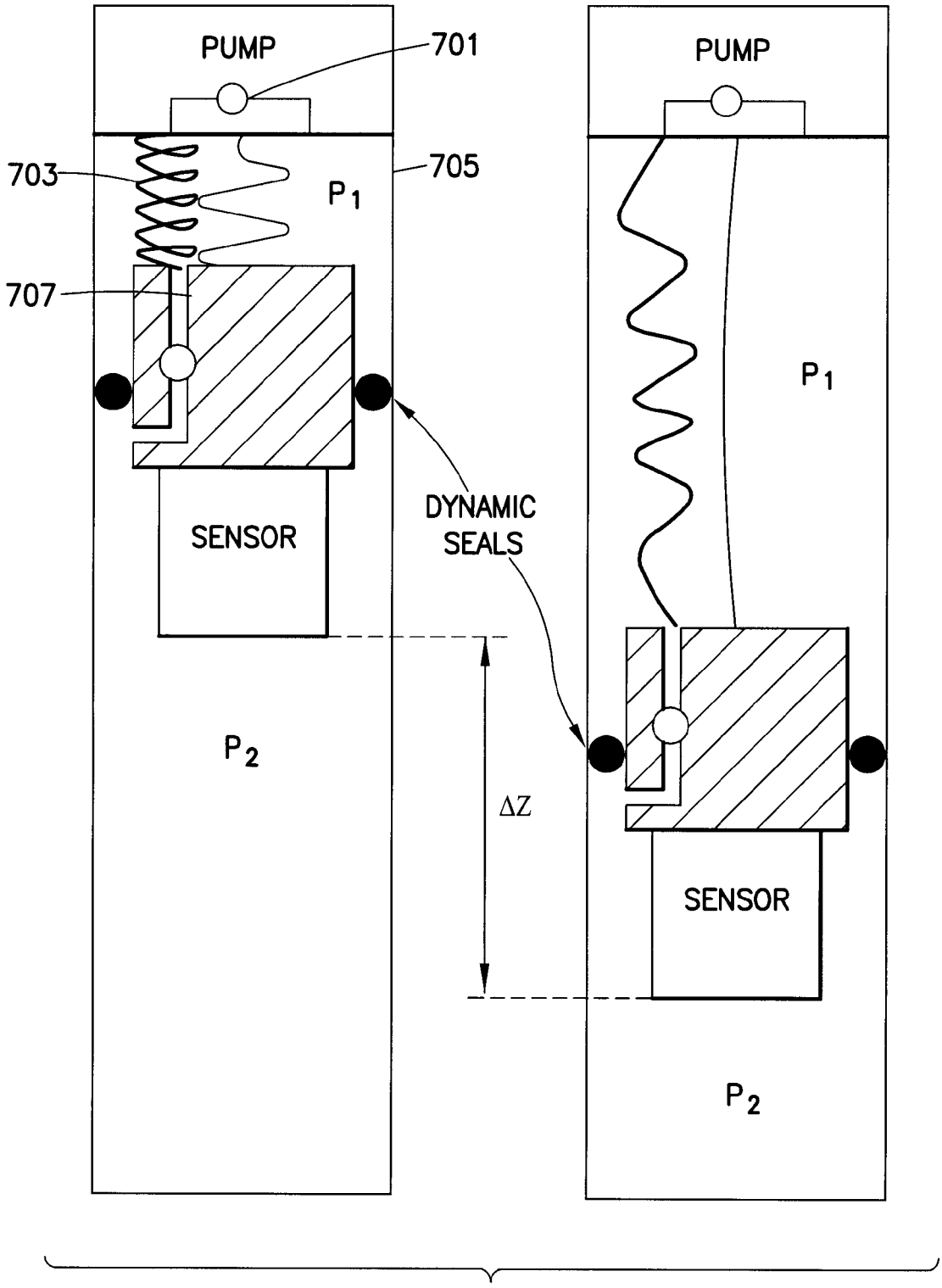
FIG. 7 illustrates a further embodiment of the subject disclosure.

FIG. 7 depicts a further embodiment of the present technology. The pump 701 is attached to the housing 705. The mechanism further comprises a flexible tubing 703 connecting the pump 701 to a port 707. The port 707 allows the working fluid to flow from the lower chamber up through the flexible tubing into the pump or vice versa. The pump remains stationary which may be desirable in certain applications.

Embodiments of the present disclosure may be used wherever the position of an object e.g. sensor is desired to be changed along the axis of a housing, for example, the housing of a tool. A number of sensors which may utilize the present disclosure include the following: A gravity tool which measures gravity at one location and then the sensor is moved a known distance along the borehole axis and gravity is measured again. The change in gravity over the known change in position can be used to measure density. In the case of either an electromagnetic or sonic tool a variable depth of investigation can be achieved by moving the transmitter or receiver along the axis of the borehole using the subject technology. Finally, in situations where measurements are needed without stopping the movement of a toolstring the subject technology may be useful. The pump/sensor assembly 213 may move in the direction opposite the toolstring at the same speed as the toolstring. In situations where tool sticking may occur and the operator of the tool wants to avoid stopping which is common for both wireline logging and drilling measurements the subject technology may be advantageous.

While the subject disclosure is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. An apparatus comprising:

an elongated, hollow vessel;

a fluid filled housing disposed inside the vessel, the housing defining a hydraulically isolated chamber comprising a first chamber and a second chamber;

a pump member disposed inside the hydraulically isolated chamber;

an element attached to the pump member; and wherein the pump member provides a differential pressure thus moving the pump member and element inside the housing in a longitudinal direction.

2. The apparatus of claim 1 wherein the first chamber and the second chamber are separated by the pump member.

3. The apparatus of claim 2 wherein the pump member comprises a fluid inlet and a fluid outlet and the fluid is allowed to flow in either direction between the first chamber and the second chamber.

4. The apparatus of claim 1 wherein the pump member further comprises a seal which seals between the pump member and the housing.

5. The apparatus of claim 1 wherein an increase in fluid pressure in the first or second chamber will cause the pump member and element to move in the longitudinal direction, wherein the longitudinal direction is in an opposite direction to a fluid flow.

6. The apparatus of claim 1 wherein an increase in fluid pressure in the first or the second chamber moves the pump member and element a first distance from a first position.

7. The apparatus of claim 1 further comprising a flexible cable connecting the pump member to the housing.

8. The apparatus of claim 7 wherein the flexible cable transmits one of a power and a signal between the pump member and the housing.

9. The apparatus of claim 1 wherein movement of the pump member and element is limited by the length of the elongated hollow vessel.

10. The apparatus of claim 1 wherein the element is a sensor element.

11. The apparatus of claim 1 wherein the sensor element is a gravity sensor.

12. The apparatus of claim 11 wherein a means for determining the displacement of the sensor element is an optical encoder.

13. The apparatus of claim 11 wherein a means for determining the displacement of the sensor element is a cable transducer.

14. The apparatus of claim 1 wherein movement of the pump member and element is achieved by the fluid moving from the first chamber to the second chamber or vice versa.

15. The apparatus of claim 1 wherein movement of the pump member and element is controlled by adjusting a volume of the fluid so as to regulate pressure applied to the pump member and element.

16. The apparatus of claim 1 wherein the pump member is a bidirectional pump.

17. The apparatus of claim 5 wherein the seal is a dynamic seal.

18. The apparatus of claim 1 wherein the pump member provides thrust to move the pump member and element inside the length of the housing.

19. The apparatus of claim 1 wherein the fluid is one of oil or water or a mixture of both oil and water.

20. The apparatus of claim 1 wherein the elongated hollow vessel is an oilfield tool housing.

21. The apparatus of claim 20 wherein the oilfield tool housing is a drill collar.

22. The apparatus of claim 1 further comprising a hydraulic accumulator to lock the apparatus at different positions along the length of the housing.

23. An apparatus comprising:

an elongated, hollow vessel;

a fluid filled housing disposed inside the vessel, the housing defining a hydraulically isolated chamber comprising a first chamber and a second chamber;

a pump member disposed inside the hydraulically isolated chamber and attached to the housing;

a flexible tubing connecting the pump member to a port assembly;

an element attached to the port assembly; and wherein the pump member provides a differential pressure thus moving the port assembly and element inside the length of the housing.

24. The apparatus of claim 23 wherein the port assembly further comprises a seal which seals between the port assembly and the housing.

25. A method for moving an element inside a housing comprising:

disposing a fluid filled housing inside an elongated, hollow vessel, defining a hydraulically isolated chamber comprising a first chamber and a second chamber with the fluid filled housing;

disposing a pump member inside the hydraulically isolated chamber;

attaching an element to the pump; and providing a differential pressure with the pump member and thus moving the pump member and element inside the housing in a longitudinal direction.

* * * * *